US007401475B2

(12) United States Patent
Hugenroth et al.

(10) Patent No.: US 7,401,475 B2
(45) Date of Patent: Jul. 22, 2008

(54) THERMODYNAMIC SYSTEMS OPERATING WITH NEAR-ISOTHERMAL COMPRESSION AND EXPANSION CYCLES

(75) Inventors: Jason J. Hugenroth, Baton Rouge, LA (US); James E. Braun, West Lafayette, IN (US); Eckhard A. Groll, West Lafayette, IN (US); Galen B. King, West Lafayette, IN (US)

(73) Assignee: Purdue Research Foundation, West LaFayette, IN (US)

( * ) Notice: Subject to any disclaimer, the term of this patent is extended or adjusted under 35 U.S.C. 154(b) by 157 days.

(21) Appl. No.: 11/466,995

(22) Filed: Aug. 24, 2006

(65) Prior Publication Data

US 2007/0074533 A1 Apr. 5, 2007

Related U.S. Application Data

(60) Provisional application No. 60/596,019, filed on Aug. 24, 2005.

(51) Int. Cl.
*F25B 23/00* (2006.01)

(52) U.S. Cl. ..... 62/467; 62/335

(58) Field of Classification Search ..... 62/467, 62/498, 333, 335; 165/62
See application file for complete search history.

(56) References Cited

U.S. PATENT DOCUMENTS 3,623,332 A * 11/1971 Fernandes ..... 62/88
4,295,518 A * 10/1981 Rannenberg ..... 165/62
4,484,457 A * 11/1984 Mugele ..... 62/500

(Continued)

OTHER PUBLICATIONS

John A. Corey; "A Rotary Air-Cycle Refrigerator With Thermally-Active Liquid Pistons"; 25th Intersociety Energy Commission Engineering Conference; 1990; vol. 6.

(Continued)

*Primary Examiner*—Melvin Jones
(74) *Attorney, Agent, or Firm*—Hartman & Hartman, P.C.; Gary M. Hartman; Domenica N.S. Hartman

(57) ABSTRACT

A thermodynamic system that can approximate the Ericsson or Brayton cycles and operated in reverse or forward modes to implement a cooler or engine, respectively. The thermodynamic system includes a device for compressing a first fluid stream containing a first gas-liquid mixture having a sufficient liquid content so that compression of the gas within the first gas-liquid mixture by the compressing device is nearly isothermal, and a device for expanding a second fluid stream containing a second gas-liquid mixture having a sufficient liquid content so that expansion of the gas within the second gas-liquid mixture by the expanding device is nearly isothermal. A heat sink is in thermal communication with at least the liquid of the first gas-liquid mixture for transferring heat therefrom, and a heat source is in thermal communication with at least the liquid of the second gas-liquid mixture for transferring heat thereto. A device is provided for transferring heat between at least the gas of the first gas-liquid mixture after the first fluid stream exits the compressing device and at least the gas of the second gas-liquid mixture after the second fluid stream exits the expanding device. The compressing and expanding devices are not liquid-ring compressors or expanders, but instead are devices that tolerate liquid flooding, such as scroll-type compressors and expanders.

20 Claims, 4 Drawing Sheets

U.S. PATENT DOCUMENTS

| | | | | |
|---|---|---|---|---|
| 4,503,683 | A * | 3/1985 | Wieland et al. | 62/86 |
| 4,984,432 | A | 1/1991 | Corey | |
| 5,893,275 | A * | 4/1999 | Henry | 62/615 |
| 6,361,890 | B1 | 3/2002 | Ban et al. | |

OTHER PUBLICATIONS

Jason Hugenroth, Jim Braun, Eckhard Groll, Galen King; "Liquid-Flooded Ericsson Cycle Cooler: Part 1—Thermodynamic Analysis"; International Refrigeration and Air Conditioning Conference; Jul. 17-20, 2006.

Jason Hugenroth, Jim Braun, Eckhard Groll, Galen King; "Liquid-Flooded Ericsson Cycle Cooler: Part 2—Experimental Results"; International Refrigeration and Air Conditioning Conference; Jul. 17-20, 2006.

* cited by examiner

THERMODYNAMIC SYSTEMS OPERATING WITH NEAR-ISOTHERMAL COMPRESSION AND EXPANSION CYCLES

CROSS REFERENCE TO RELATED APPLICATIONS

This application claims the benefit of U.S. Provisional Application No. 60/596,019, filed Aug. 24, 2005, the contents of which are incorporated herein by reference.

BACKGROUND OF THE INVENTION

The present invention generally relates to thermodynamic systems, and more particularly to thermodynamic systems operating according to the Ericsson or Brayton cycle and capable of achieving near-isothermal compression and expansion of a gas by mixing therewith a substantial quantity of liquid.

A refrigeration machine, heat pump, or cooler can be defined as any device that moves heat from a low temperature source to a high temperature sink. Operation of a refrigeration machine requires an input of energy, usually thermal, mechanical or electrical. Depending on the specific need, the heat absorbed in the low temperature source can be utilized to provide cooling, or the heat rejected to the high temperature sink can be used to provide heating, or both may be utilized simultaneously. As an example, for a typical household refrigerator the low temperature source is the space inside the refrigerator and the high temperature sink is the air in the room where the refrigerator is placed. Electrical energy is typically used to operate the system.

With the exception of a few niche applications, virtually all refrigeration machines operate on the vapor-compression (V-C) cycle. Common examples include home and automobile air conditioners, domestic and industrial food refrigeration, commercial comfort cooling, industrial process cooling, and many others. The traditional refrigerant fluids used in these machines contain compounds that result in ozone depletion if they escape into the upper atmosphere. These ozone depleting refrigerants are in the process of being phased out and eventually banned. However the new refrigerants, while not posing a risk to the ozone layer, are very potent greenhouse gasses. Other refrigerants that don't pose a substantial environmental risk have other drawbacks, such as being flammable or toxic. One such example is ammonia, which is an excellent refrigerant from a system performance perspective, but is highly toxic. There is a great need and much work is being done to develop and commercialize practical refrigeration systems that do not require the use of environmentally hazardous refrigerants.

The reverse Ericsson cycle is an alternative refrigeration cycle capable of operating with benign refrigerants, such as air, argon, xenon, and helium. The Ericsson cycle combines four thermodynamic processes. For an ideal cycle that uses a gas as the working material, the processes are isothermal (constant temperature) compression, constant pressure heat rejection from the high pressure stream to the low pressure stream, isothermal expansion, and constant pressure heat addition to the low pressure stream from the high pressure stream. A system that approximates these processes can be termed an Ericsson device or machine. The Ericsson cycle has several notable advantages. For example, the cycle is thermodynamically reversible, meaning that its coefficient of performance (COP) is theoretically the same as the Carnot COP, which is the maximum efficiency any refrigeration machine can achieve while operating between given temperatures.

Another advantage of the Ericsson cycle is that it can use fluid refrigerants that pose no or low environmental risk. Virtually any gas can be used as the working fluid, including the aforementioned air, argon, xenon, and helium as well as other readily available gases such as carbon dioxide.

The principle difficulty of implementing a practical device that operates in a manner substantially similar to the Ericsson cycle is the requirement for isothermal or near isothermal compression and expansion of the working fluid to achieve a reasonable efficiency. When a gas is compressed, the temperature of the gas increases. To keep the temperature of the gas constant during compression, the gas must be cooled while it is compressed. In practice, isothermal compression of a gas is extremely difficult to achieve because, for practical compression machines, the area available for heat transfer is very small and the compression process occurs very quickly. Slowing down the compression process or increasing the surface area for heat transfer leads to very large, impractical, and expensive machinery.

U.S. Pat. No. 4,984,432 to Corey discloses an Ericsson cycle machine that uses liquid ring compressors to compress and expand a gas-liquid mixture. However, several disadvantages are believed to exist with this machine as disclosed. First, liquid ring compressors have difficulty producing large pressure differentials, which can result in small volumetric capacities and necessitate large equipment to achieve relatively small cooling capacities. Liquid ring compressors also exhibit low efficiencies due in part to high viscous (fluid friction) losses, resulting in tremendous degradation of performance. Furthermore, the power required to pump the liquid through the heat exchanger loops is substantial, with no means disclosed to recover this power. Another shortcoming is that the liquid ring is simultaneously in substantial thermal contact with both the inlet and outlet gas streams, which has the undesirable effect of preheating the suction gas on the compression side and precooling the inlet gas on the expander side and results in higher compression work and lower expander work recovery, respectively. In any event, a thermodynamic analysis of the cycle is not presented in the Corey patent, and attempts to test the disclosed Ericsson cycle machine have failed to achieve a net heat pumping effect.

BRIEF SUMMARY OF THE INVENTION

The invention pertains to a thermodynamic system that can approximate the Ericsson or Brayton cycles and operated in reverse or forward modes to implement a refrigeration device (e.g., a cooler or heat pump) or engine, respectively.

The thermodynamic system includes a device for compressing a first fluid stream containing a first gas-liquid mixture having a sufficient liquid content so that compression of the gas within the first gas-liquid mixture by the compressing device is nearly isothermal, and a device for expanding a second fluid stream containing a second gas-liquid mixture having a sufficient liquid content so that expansion of the gas within the second gas-liquid mixture by the expanding device is nearly isothermal. A heat sink is in thermal communication with at least the liquid of the first gas-liquid mixture for transferring heat therefrom, and a heat source is in thermal communication with at least the liquid of the second gas-liquid mixture for transferring heat thereto. Finally, a device is provided for transferring heat between at least the gas of the first gas-liquid mixture after the first fluid stream exits the compressing device and at least the gas of the second gas-liquid mixture after the second fluid stream exits the expanding device. According to the invention, the compressing and expanding devices are not liquid-ring compressors or expanders, but instead are devices that are very tolerant of liquid flooding, such as scroll-type compressors and expanders.

The current invention overcomes the difficulty of achieving isothermal compression and expansion in Ericsson and Brayton cycles (or approximations thereof) by mixing a substantial quantity of liquid into the gas during the compression and expansion processes. Since the liquid is in intimate contact with the gas, and can be injected in the form of a mist to promote contact, excellent heat transfer between the gas and liquid is able to occur. Because the liquid have a larger thermal mass compared to the gas being compressed, the liquid absorbs a large amount of the heat of compression. The temperature of the gas therefore remains nearly constant during the compression process. Benefits to the expansion process are analogous.

It should be noted that flooding with liquid will damage most gas compression and expansion machines because, unlike a gas, a liquid is substantially incompressible. Therefore very large forces are produced on compression and expansion machinery if an attempt is made to compress a liquid. However, scroll compressors and expanders have been shown to be very tolerant of liquid flooding when implemented with the thermodynamic system of this invention. Because the volume ratio of a scroll compressor is fixed and relatively small, a scroll compressor is able to accommodate liquid within compression pockets in the compressor. In addition to scroll-type compressors, other types of compressors are believed to be tolerant of liquid flooding, particularly screw compressors. In addition, vane-type rotary compressors can also be configured to accommodate liquid flooding to the extent necessary for use in the present invention.

Another advantage of the invention is the ability to use many different liquids in the thermodynamic system, including water, mineral oil, or natural biodegradable oils such as rapeseed oil. One advantage of using an oil as the heat transfer fluid is that it can also be used as the lubricant for mechanical components in the system. In addition, because oils are generally strong dielectrics, their use can be combined in a hermetic system that encloses mechanical components of the system, such as electric motors used to drive the compressor.

Other objects and advantages of this invention will be better appreciated from the following detailed description.

DETAILED DESCRIPTION OF THE INVENTION

The invention is described in reference to thermodynamic systems that employ Ericsson or Brayton cycles in combination with liquid flooding during compression and expansion of a compressible fluid so that the compression and expansion processes are nearly isothermal. As will be evident from the following, numerous liquids can be used as the flooding liquid and numerous gases can be used as the compressible fluid. Particular examples of suitable compressible fluids include air, argon, xenon, helium, etc., though others could also be used, with a preference for fluids that are not toxic, flammable, ozone-depleting, or potent greenhouse gases. Particular examples of suitable liquids include water, mineral oil, natural biodegradable oils such as rapeseed oil, etc. In some cases, nonvolatile liquids will likely be preferred, though it is believed that the use of a liquid (e.g., water) that partially vaporizes and condenses as it goes through compression and expansion, respectively, would result in more isothermal compression and expansion at lower liquid flooding rates, which has potential advantages. Those skilled in the art will appreciate that suitable temperatures, pressures, etc., for the operation of the systems will depend on the particular liquids and gases used.

Those skilled in the art will also appreciate that compressors and expanders suitable for use with the invention must be tolerant of liquid flooding. While scroll-type compressors and expanders will be described in reference to the multiple embodiments of this invention, the thermodynamic system can be implemented using other types of compressors and expanders that are relatively tolerant of liquid flooding, including but not limited to screw compressors, rotary vane compressors, diaphragm compressors, and even rotary and reciprocating piston compressors if sufficient clearance volume is introduced to prevent damage to components. Furthermore, it is foreseeable that centrifugal machine could be modified or designed for this purpose. The construction and operation of such compressors and expanders are well documented in the art, and therefore will not be repeated here.

Figure 1:
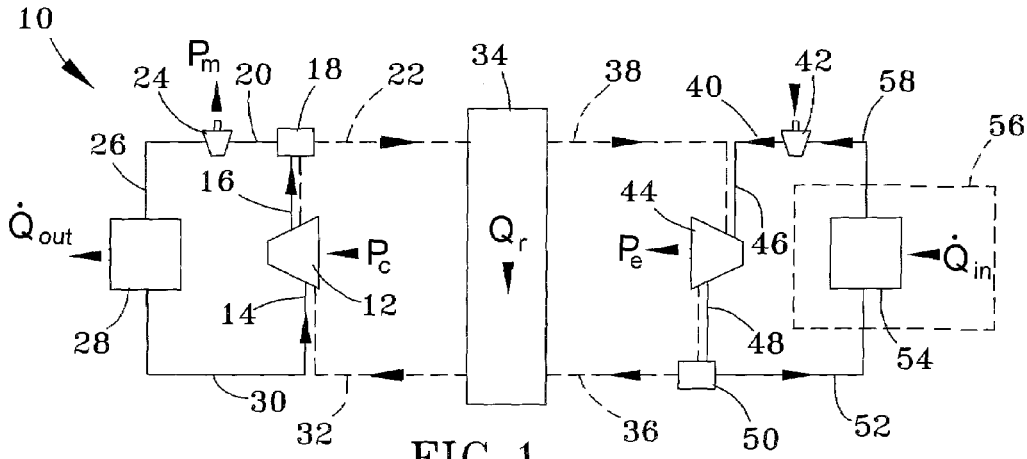
FIG. 1 is a schematic of a thermodynamic system operating as an Ericsson cycle cooler with liquid flooding in accordance with an embodiment of this invention.

In reference to FIG. 1, a thermodynamic system is represented as a reverse Ericsson cycle system 10 that employs a scroll compressor 12 and scroll expander 44. In FIG. 1, a low-pressure high-temperature gas-liquid mixture 14 enters the compressor 12 and is compressed to a higher pressure. (In the Figures, liquid streams are represented by a solid line, gas streams are represented by a dashed line, and gas-liquid mixtures are represented by combined solid and dashed lines.) Because the liquid and gas are in intimate thermal contact during compression and the thermal capacitance of liquids is typically significantly greater than that of the gas within the mixture 14, the system 10 is operated so that the heat of compression of the gas within the mixture 14 is absorbed by the liquid within the mixture 14, preferably to the extent that the gas is compressed nearly isothermally. This relationship can be quantified as the capacitance rate ratio ($C_{ratio}$), defined as $$C_{ratio}=m_l c_l/m_g c_{p.g.}$$

where $m_l$ and $c_l$ are respectively the mass flow rate and thermal capacitance of the liquid, the product of $m_l$ and $c_l$ is the thermal capacitance rate of the liquid, $m_g$ and $c_{p.g.}$ are respectively the mass flow rate and thermal capacitance of the gas, and the product of $m_{g.}$ and $c_{p.g.}$ is the thermal capacitance rate of the gas. From the above equation, it is evident that the $C_{ratio}$ of the system 10 will depend on the particular gas and liquid used and their relative amounts. In some cases, the thermal capacitance rate of the liquid may be much greater than that of the gas (i.e., Cratio>>1). However, it is believed that in some cases the system 10 can operate with a $C_{ratio}$ of approximately 1. In all cases, the relative amount of liquid in the gas-liquid mixture 14 (in other words, the liquid flooding during compression and, as discussed below, during expansion) should be substantial enough to significantly reduce the temperature change of the gas during the compression process (as well as during the expansion process).

The compressor 12 is indicated as being powered ($P_c$) by an electric motor or other suitable device (not shown). The high-pressure high-temperature gas-liquid mixture 16 exiting the compressor 12 enters a high temperature gas-liquid separator 18, which can be of a type well known in the art. A high-pressure high-temperature liquid stream 20 and a high-pressure high-temperature gas stream 22 separately exit the separator 18, from which the liquid stream 20 enters a liquid circuit containing a liquid motor 24 that reduces the pressure of the liquid stream 20 to a relatively low level. Work ($P_m$) from the liquid motor 24 can be recovered and used to drive the compressor 12 and/or other devices within the system, such as a liquid pump 42 within a second liquid circuit of the system 10. The resulting low-pressure high-temperature liquid stream 26 exits the liquid motor 24 and enters a high-temperature heat exchanger 28, where heat from the low-pressure high temperature liquid stream 26 is rejected to a high-temperature sink ($Q_{out}$) The resulting low-pressure high-temperature liquid stream 30 exiting the heat exchanger 28 is subsequently mixed with a low-pressure high-temperature gas stream 32 to reform the low-pressure high-temperature gas-liquid mixture 14 delivered to the compressor 12.

The high-pressure high-temperature gas stream 22 separated by the separator 18 enters a regenerator 34, where heat ($Q_R$) from the gas stream 22 is rejected to a low-pressure low-temperature gas stream 36 (discussed below). The resulting high-pressure low-temperature gas stream 38 that exits the regenerator 34 preferably has a temperature near that of a refrigerated space 56 cooled by the second liquid circuit of the system 10. The gas stream 38 mixes with a high-pressure low-temperature liquid stream 40 from the liquid pump 42, forming a high-pressure low-temperature gas-liquid mixture 46 that enters the scroll expander 44. Within the expander 44, the gas-liquid mixture 46 is expanded nearly isothermal as a result of intimate thermal contact between the liquid and gas during expansion and the significantly greater thermal capacitance of the liquid. The expander 44 produces work ($P_e$) that can be used to provide power for other components of the system 10, including the compressor 12 and liquid pump 42, through various known arrangements such as direct shaft coupling. The resulting low-pressure low-temperature gas-liquid mixture 48 then enters a low-temperature gas-liquid separator 50, which separates the gas-liquid mixture 48 into a low-pressure low-temperature liquid stream 52 and the aforementioned low-pressure low-temperature gas stream 36.

The low-pressure low-temperature liquid stream 52 enters a cold heat exchanger 54, where the liquid stream 52 absorbs heat from the refrigerated space 56. The resulting low-pressure low-temperature liquid stream 58 exiting the cold heat exchanger 54 enters the liquid pump 42, where its pressure is increased to the high system pressure. The low-pressure low-temperature gas stream 36 from the low-temperature gas-liquid separator 50 enters the regenerator 34, where it absorbs heat from the high-pressure high-temperature gas stream 22 separated by the high-temperature gas-liquid separator 18. The resulting low-pressure high-temperature gas stream 32 exiting the regenerator 34 is at a temperature near the hot side temperature of the system 10, i.e., near that of the low-pressure high-temperature liquid stream 30.

The reverse Ericsson cycle of the system 10 operates in a continuous fashion as described. The locations of the liquid motor 24 and liquid pump 42 can be on either side of the heat exchangers 28 and 54, respectively. Furthermore, the liquid motor 24 can be replaced with a throttling valve (not shown), though with a loss in system performance. If so desired, different liquids can be used in the hot side of the system 10 (to the left of the regenerator 34 in FIG. 1) and cold side of the system 10 (to the right of the regenerator 34 in FIG. 1). As an example, the use of different liquids can be advantageous if the system 10 operates under extreme temperature differentials where a single liquid would either vaporize or solidify at the hot and cold sides, respectively. For instance, a cryogenic application for the system 10 could use water or oil on the hot side of the system 10 and liquid nitrogen on the cold side of the system 10, with helium or nitrogen used as the gas for the gas loop.

FIGS. 2 through 12 depict additional thermodynamic systems in accordance with further embodiments of this invention. For convenience, in these Figures consistent reference numbers are used to identify functionally similar structures.

Figure 2:
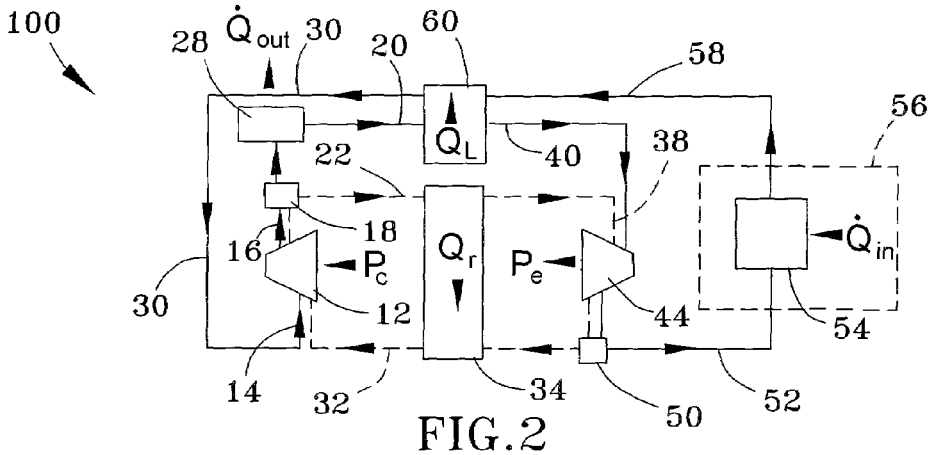
FIG. 2 is a schematic of a modified thermodynamic system operating as an Ericsson cycle cooler with liquid flooding in accordance with another embodiment of this invention.

FIG. 2 is an alternative reverse Ericsson cycle system 100 to that of FIG. 1, with the primary difference being the elimination of the liquid motor 24 and liquid pump 42. In this embodiment, the gas-liquid mixture 14 enters the scroll compressor 12, where it is compressed nearly isothermally and exits the compressor 12 before entering the separator 18. As before, the separator 18 separates the liquid and gas of the mixture 16, and the resulting high-pressure high-temperature liquid stream 20 enters the high temperature heat exchanger 28 where heat ($Q_{out}$) is rejected from the liquid stream 20 to the high-temperature heat sink. In contrast to the embodiment of FIG. 1, the high-pressure high-temperature liquid stream 20 then enters a liquid regenerator 60, where heat ($Q_L$) is rejected to the low-pressure low-temperature liquid stream 58 from the low temperature heat exchanger 54. The high-pressure liquid stream 40 exiting the liquid regenerator 60 is now at a low temperature, and is then mixed with the high-pressure low-temperature gas stream 38 before entering the scroll expander 44. As before, the resulting high-pressure low-temperature gas-liquid mixture 46 is expanded nearly isothermally by the expander 44, after which the liquid and gas constituents of the now low-pressure low temperature gas-liquid mixture 48 are separated by the separator 50. The low-pressure low-temperature liquid stream 52 enters the cold heat exchanger 54, where the liquid absorbs heat from the refrigerated space 56. The low-pressure low-temperature liquid stream 58 then enters the liquid regenerator 60, where it absorbs heat from the high-pressure high-temperature liquid stream 20. The resulting low-pressure high-temperature liquid stream 30 exits the liquid regenerator 60 and is subsequently mixed with the low-pressure high-temperature gas stream 32 before entering the compressor 12. In view of the foregoing, the functions of the gas streams 22, 32, 36, and 38 are essentially the same as in the embodiment of FIG. 1. Work produced by the expander 44 can be used to offset some of the power ($P_c$) required by the compressor 12.

Figure 3:
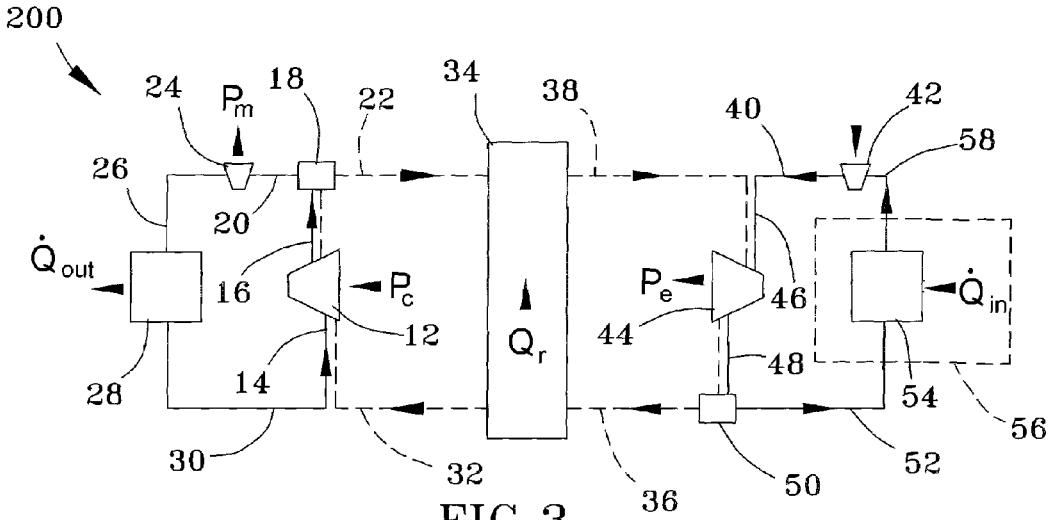
FIG. 3 is a schematic of a thermodynamic system similar to that of FIG. 1, but modified to operate as an Ericsson cycle engine in accordance with an embodiment of this invention.

FIG. 3 is an embodiment of the Ericsson cycle set forth in FIG. 1, but operated in a forward mode as a heat engine 200. Operated as an engine, the system 200 uses the expander-side heat exchanger 54 to absorb heat ($Q_{in}$) from a high temperature heat source, with the result that the gas-liquid mixture 48 downstream of the expander is at low pressure but high temperature. On the compressor side, heat ($Q_{out}$) is rejected from the liquid stream 26 to a low temperature heat sink, with the result that the gas-liquid mixture 16 downstream of the compressor 12 is at high pressure but low temperature. Because the temperatures of the gas and liquid streams on the expander-side of the system 200 are elevated relative to the gas and liquid streams on the compressor-side of the system 200 (opposite that of FIG. 1), the regenerator 34 operates to transfer heat from the low-pressure high-temperature gas stream 36 downstream of the expander 44 to the high-pressure low-temperature gas stream 22 downstream of the compressor 12. The expander work ($P_e$) is greater than the compressor work ($P_w$) and a net power output is achieved. A portion of the expander work ($P_e$) can be delivered to the compressor 12 through a shaft (not shown). Otherwise, the individual components of the system 200 in FIG. 3 operate in a very similar manner to the identical components of the system 10 in FIG. 1.

Figure 4:
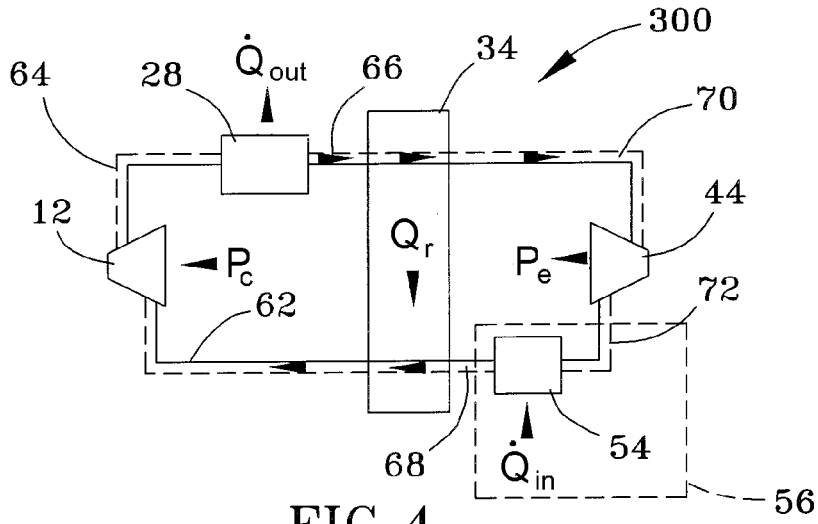
FIG. 4 is a schematic of a thermodynamic system operating as a Brayton cycle cooler with liquid flooding in accordance with an embodiment of this invention.

FIG. 4 is a schematic of a reverse Brayton cycle system 300 utilizing a scroll compressor 12 and scroll expander 44 with liquid flooding, similar to FIGS. 1 and 2. Most notably, the entire system 300 operates on a mixture of gas and liquid, with essentially only pressure and temperature being variable. A low-pressure high-temperature gas-liquid mixture 62 enters the compressor 12, where it is compressed nearly isothermally. The resulting high-pressure high-temperature gas-liquid mixture 64 enters the hot heat exchanger 28, where the mixture 64 rejects heat to a high-temperature heat sink. The resulting high-pressure high-temperature gas-liquid mixture 66 exits the heat exchanger 28 and enters the regenerator 34, where heat ($Q_R$) is reject to a low-pressure low-temperature gas-liquid mixture 68. The resulting high-pressure gas-liquid mixture 70, now at a low temperature, enters the expander 44 where it is expanded nearly isothermally. The resulting low-pressure low-temperature gas-liquid mixture 72 exits the expander 44 then enters the cold heat exchanger 54, where heat is absorbed from the refrigerated space 56. The resulting low-pressure low-temperature gas-liquid mixture 68 exits the cold heat exchanger 54 and enters the regenerator 34, where heat is absorbed from the high-pressure, high-temperature gas-liquid mixture 66. The work ($P_e$) produced by the expander 14 can be used to offset some of the work ($P_c$) required by the compressor 12.

The embodiment of FIG. 4 is more efficient than a simple reverse Brayton gas cycle because the compression and expansion processes occur nearly isothermally. As with the Ericsson cycle systems 10 and 100 of FIGS. 1 and 2, the system 300 of FIG. 4 can be operated as a heat engine by replacing the refrigerated space 56 with a high-temperature heat source. In this case, the heat exchanger 28 becomes a low temperature heat sink. Notably, the flow direction of the gas-liquid mixture is also reversed.

Figure 5:
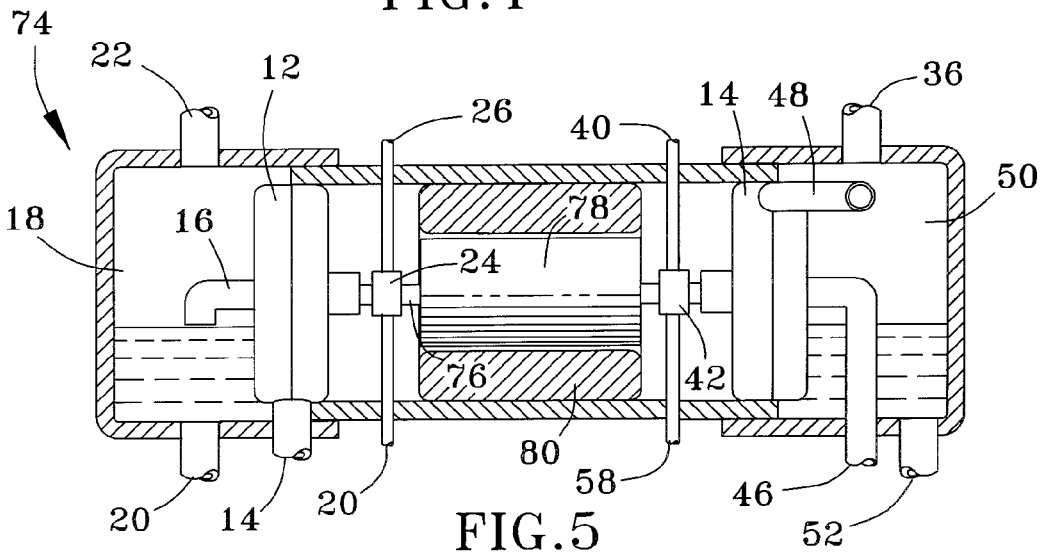
FIG. 5 is a schematic sectional view of integral compression, expansion, and separation machinery for use with an Ericsson cycle system of this invention.

FIG. 5 represents a sectional view of a portion of any one of the Ericsson systems of FIGS. 1 and 3, in which the compressor 12, expander 44, liquid motor 24, liquid pump 42, and separators 18 and 50 are part of an integral unit 74. The scroll compressor 12 and scroll expander 44 are axially opposed in a common shaft 76. A motor rotor 78 is located between the compressor 12 and expander 44 on the shaft 76. The liquid pump 42 and liquid motor 24 are also driven by shaft 76. The separators 18 and 50 are located on opposite ends of the unit 74. The remaining components attach to the unit 74 through open-ended connections as shown. The integral unit 74 greatly simplifies the system designs shown schematically in FIGS. 1 and 3. By eliminating the liquid motor 24 and liquid pump 42, the integral unit 74 is further simplified for use with the system 200 shown schematically in FIG. 2, and could also be used with additional modifications for implementation of the Brayton cycle system 300 of FIG. 3.

Figure 6:
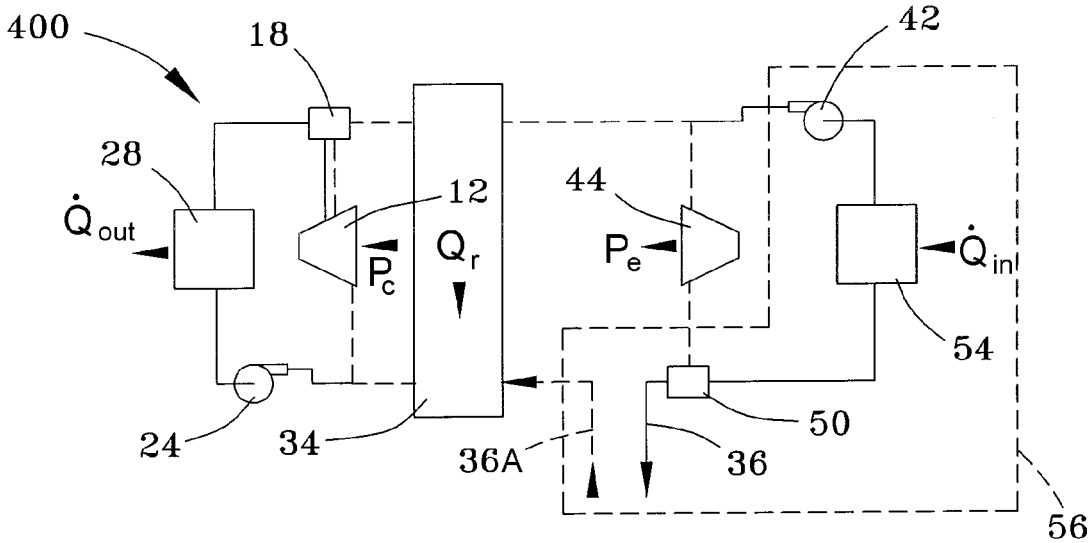
FIG. 6 is a schematic of a modified thermodynamic system operating as an Ericsson cycle cooler with liquid flooding in accordance with an embodiment of this invention.

FIG. 6 shows a schematic representation of an open Ericsson cooler system 400 that operates in the same manner as the system of FIG. 1, with the exception that the low-pressure low-temperature gas stream 36 exiting the separator 50 is in fluid communication with the refrigerated space 56, such that the gas stream 36A that is passed through the regenerator 34 is drawn from the refrigerated space 56.

In principle, the liquids in the hot and cold loops of the system 10 represented in FIG. 1 are isolated from each other and do not intermix. In practice, however, the hot-side and cold-side separators 18 and 50 will not be able to entirely remove the liquids from each gas-liquid mixture 16 and 48, so that the gas streams 22, 32, 36, and 38 flowing between both sides of the system 10 will transport liquid from one side to the other. Due to normal manufacturing variations and differences in flow velocities and other conditions between the separators 18 and 50, it will likely always be the case that gas flowing from one side of the system 10 will contain more liquid than gas flowing from the other side of the system 10. Under this assumption, after many hours of running, liquid will accumulate on one side of the system 10. To prevent this, means can be provided for equalizing the liquid between the two sides of the system 10. While various techniques can be devised to accomplish this, a passive equalization system and an active equalization system are shown for this purpose in FIGS. 7 and 8.

Figure 7:
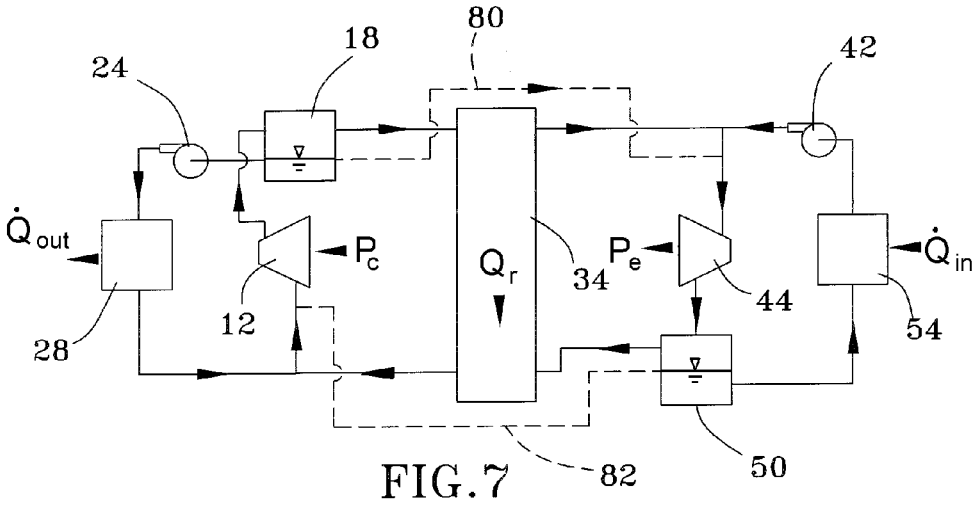
FIGS. 7 and 8 are schematics of Ericsson cycle coolers similar to FIG. 1, but further equipped with means for equalizing the amount of flooding liquid within two liquid circuits of the system in accordance with an embodiment of this invention.
Figure 8:
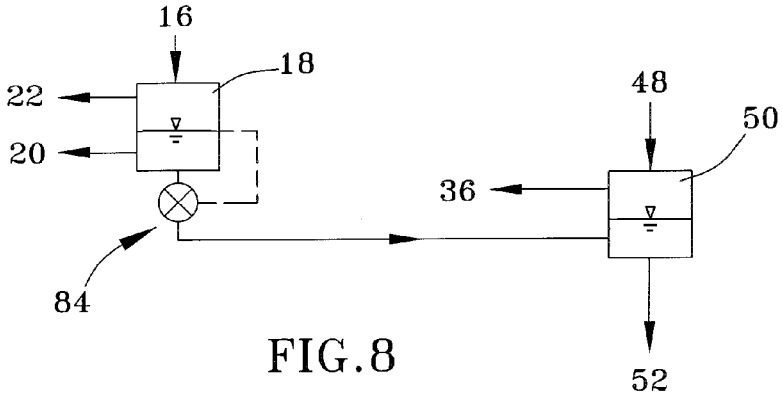

In FIG. 7, flow paths 80 and 82 can be formed by tubes that pierce the separators 18 and 50, respectively, at the approximate levels that the liquids are to be maintained in the separators 18 and 50. At the downstream end of the flow path 80, the tube is in fluid communication with, for example, the gas-liquid mixture 46 upstream of the expander 44, while the downstream end of the flow path 82 fluidically communicates with, for example, the gas-liquid mixture 14 upstream of the compressor 12. Because of flow losses, the pressures at the downstream ends of the flow paths 80 and 82 are slightly lower than at the separators 18 and 50, such that pumps are not required for equalization. FIG. 8 addresses a situation in which there is a tendency for liquid to accumulate in the separator 18. The flow path 80 is equipped with a float-type metering valve that opens and allows liquid to flow to the separator 50 when the liquid level in the separator 18 reaches a predetermined level.

Figure 9:
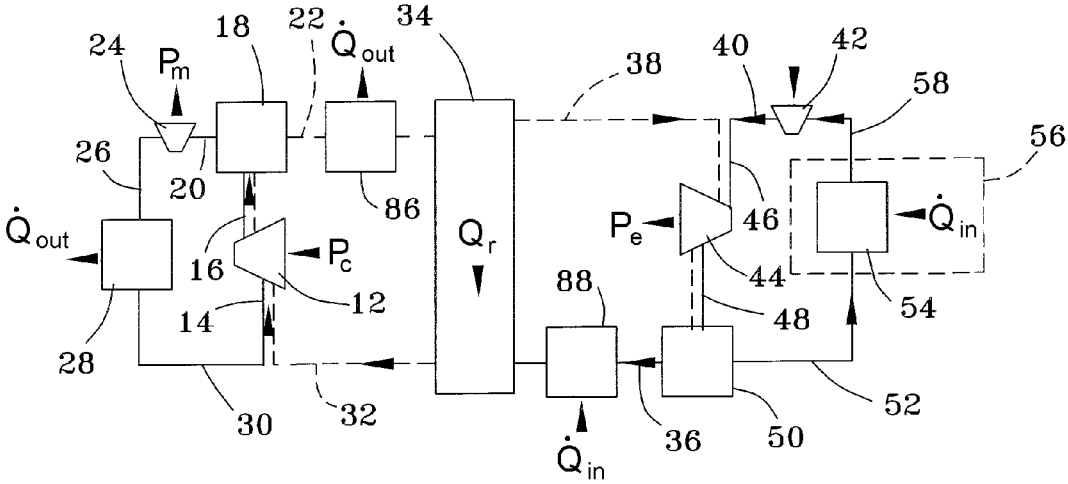
FIG. 9 is a schematic of an Ericsson cycle cooler similar to FIG. 1, but further equipped with additional heat exchangers to improve the performance of the system as a heat pump or heat engine in accordance with an additional embodiment of this invention.

As previously noted, the compression and expansion processes of the various systems shown in the Figures will be nearly isothermal if sufficient liquid is mixed with the gas during compression and expansion. In practice, however, there will still likely be a temperature rise or drop during flooded compression and expansion, respectively, in which case it can be advantageous to place additional heat exchangers 86 and 88 as shown in FIG. 9. The additional heat exchangers 86 and 88 are in an arrangement similar to a Brayton cycle cooler, and serve to improve the performance of an Ericsson cycle system, whether for a heat pump (e.g., FIG. 1) or a heat engine (e.g., FIG. 3).

Figure 10:
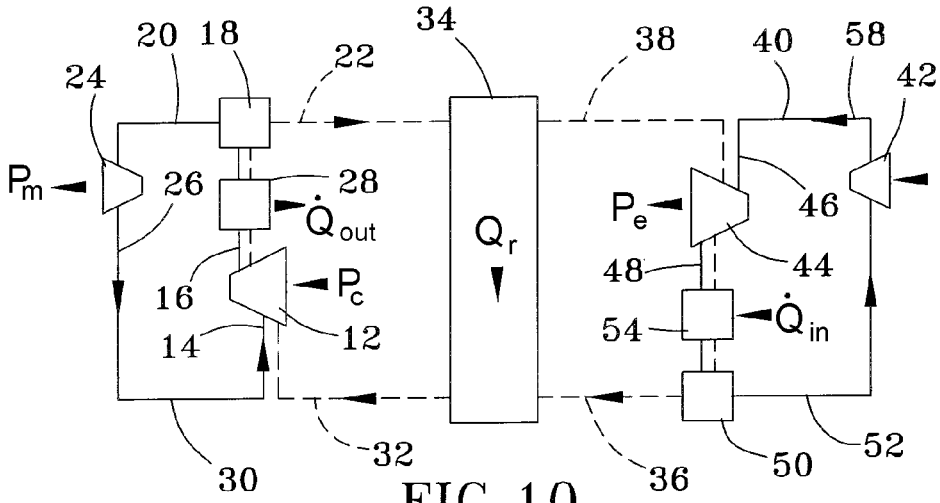
FIG. 10 is a schematic of an Ericsson cycle cooler similar to FIG. 1, but with heat exchangers relocated.

FIG. 10 represents a further modification of FIG. 1 in which the heat exchangers 28 and 54 are relocated directly downstream of the compressor 12 and expander 44, respectively. These locations allow for additional heat to be rejected ($Q_{out}$) and additional heat to be absorbed ($Q_{in}$), with the net effect that the coefficient of performance (COP) can be improved for the system 10. The improvement in COP is possibly such that the system of FIG. 10 is believed to be a preferred configuration for a reverse Ericsson cycle system of this invention.

Figure 11:
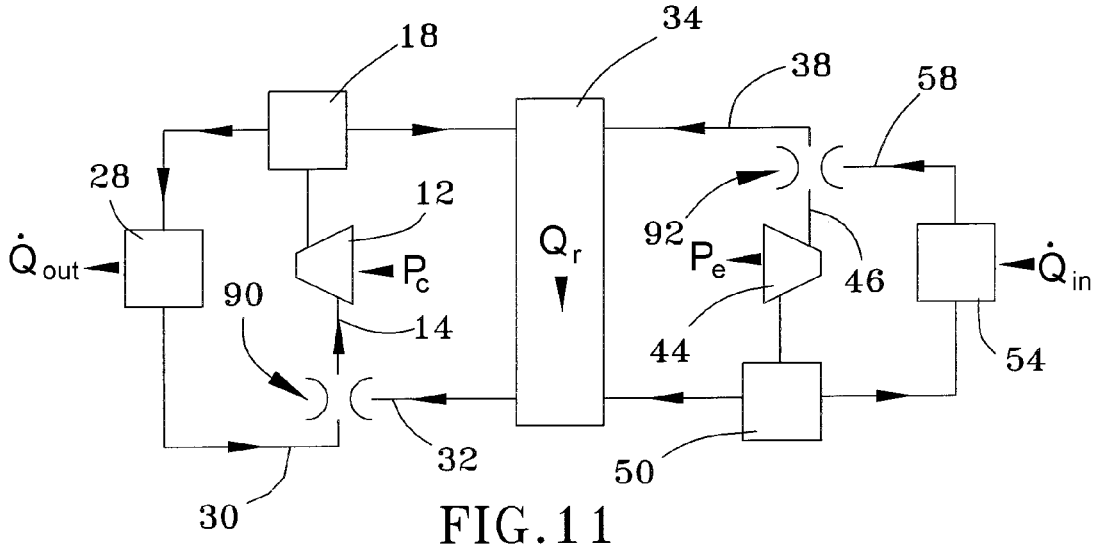
FIG. 11 is a schematic of an Ericsson cycle cooler similar to FIG. 1, but modified to use ejectors.

In another embodiment shown in FIG. 11, the liquid motor 24 and pump 42 are replaced with ejectors 90 and 92, respectively. As known in the art, ejectors use a high pressure fluid stream to compress a low pressure fluid stream to an intermediate pressure. Therefore, in the embodiment of FIG. 11, the ejector 90 is employed to reduce the pressure of the liquid stream 30 entering the compressor 12, and the ejector 92 is employed to increase the pressure of the liquid stream 40 entering the expander 44.

Figure 12:
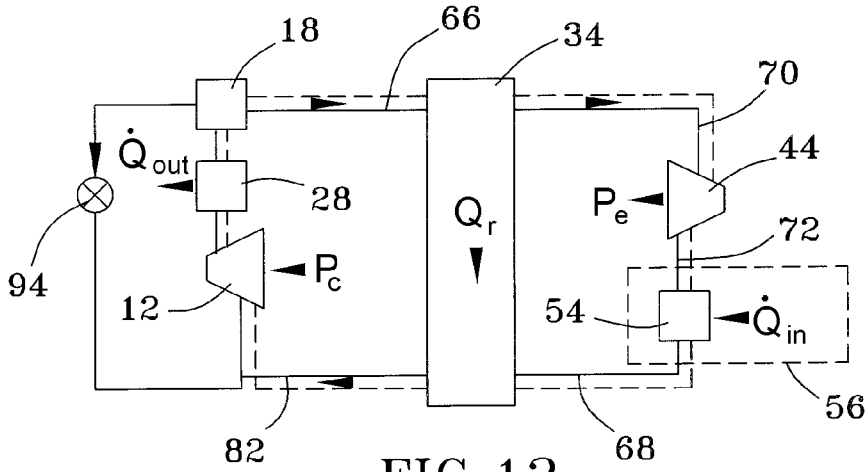
FIG. 12 is a schematic of a modified Brayton cycle cooler similar to FIG. 4.

The liquid motor 24 can also be replaced in any of the embodiments with a throttle valve 94 (or other suitable type of flow restriction), as represented in FIG. 12 with the Brayton cycle system of FIG. 4. A flow restriction is a much simpler and lower cost approach than the liquid motor 24, such as a hydraulic motor. However, system efficiency will decrease since no work is being recovered from the liquid stream as its pressure is reduced with the restriction.

In an investigation leading up to this invention, an experimental liquid-flooded Ericsson cooler system corresponding to the system 10 represented in FIG. 1 was constructed and used to perform tests. In the construction of the system, primarily off-the-shelf parts with very little modifications were used. The sizing of components used in the system was based on preliminary modeling results reported in Hugenroth et al., "Liquid-Flooded Ericsson Cycle Cooler: Part 1-Thermodynamic Analysis," Proceedings of the 2006 International Refrigeration and Air Conditioning Conference at Purdue, R168, the contents of which are incorporated herein by reference. Open drive scroll compressors were chosen for the compressor and expander in the experimental system. In addition to being readily available at low cost and at the approximate displacement volume desired, a scroll compressor can be operated as an expander by simply reversing the fluid flow through the machine.

The experimental system contained the following major components: compressor, expander, hydraulic motor, pump, hot and cold separators, hot and cold mixers, hot and cold heat exchangers, and a regenerator. The heat exchangers were commercially-available units that exchanged heat with an aqueous ethylene glycol coolant supplied by a chiller system. The regenerator was also a commercially available heat exchanger. The separators were custom-built units having a first stage for simple gravity separation of the liquid from the gas, and commercially-available centrifugal type oil separators formed a second stage to separate remaining oil from the gas. Mixing of the liquid and gas streams was accomplished simply by bringing the two streams together at a tee in the lines. Nitrogen and alkyl-benzene oil were used as the refrigerant and flooding liquid, respectively, in the experimental system.

The compressor, expander, hydraulic motor, and pump were coupled to electric motors to allow for independent speed control of each component. The expander and hydraulic motor produced power and the electric motors coupled to these components operated regeneratively. Torque cells were placed between the motor shafts and the shaft of each piece of rotating machinery to allow for torque measurements by the power produced or consumed by each component was calculated. Pressure transducers and thermocouples were located between each component in the system, flow in the liquid loops and gas loop were measured, and temperatures and flow rates of coolant flows were measured.

Approximately seventy tests were run with the experimental system under a number of conditions. The flooding liquid and compression fluid used in the experiments were alkyl-benzene oil and nitrogen, respectively, and the system was operated to evaluate $C_{ratio}$ values of about 3.5, 5, 10, and 15. Volumetric capacities of over 110 kJ/m$^3$ were measured. Though the best second law efficiency was a little over 3%, the low performance for the experimental system was anticipated due to a number of factors, including the large physical size of the system compared to its cooling capacity, and various sources of pressure drops. Details of the results of the experiments are reported in Hugenroth et al., "Liquid-Flooded Ericsson Cycle Cooler: Part 2-Experimental Results," Proceedings of the 2006 International Refrigeration and Air Conditioning Conference at Purdue, R169, the contents of which are incorporated herein by reference.

From the above, it was concluded that scroll compressors could tolerate the necessary amount of liquid flooding required for operation of a reverse Ericsson cycle according to the present invention. In addition, it was concluded that the scroll-type compressor and expander operated reliably under the flooding conditions, and that the adiabatic efficiency of both the compressor and expander were very satisfactory.

While the invention has been described in terms of specific embodiments, it is apparent that other forms could be adopted by one skilled in the art. For example, the physical configuration of the thermodynamic systems could differ from that shown in the Figures, and materials and processes other than those noted could be use. Therefore, the scope of the invention is to be limited only by the following claims.

The invention claimed is:

1. A thermodynamic system comprising:

means for compressing a first fluid stream containing a first gas-liquid mixture having a sufficient liquid content so that compression of the gas within the first gas-liquid mixture by the compressing means is nearly isothermal;

means for expanding a second fluid stream containing a second gas-liquid mixture having a sufficient liquid content so that expansion of the gas within the second gas-liquid mixture by the expanding means is nearly isothermal;

a heat sink in thermal communication with at least the liquid of the first gas-liquid mixture for transferring heat therefrom;

a heat source in thermal communication with at least the liquid of the second gas-liquid mixture for transferring heat thereto;

means for transferring heat between at least the gas of the first gas-liquid mixture after the first fluid stream exits the compressing means and at least the gas of the second gas-liquid mixture after the second fluid stream exits the expanding means;

wherein the compressing means is not a liquid-ring compressor and the expanding means is not a liquid-ring expander.

2. The thermodynamic system of claim 1, wherein the gases of the first and second gas-liquid mixtures are the same and flow in the same gas circuit within the thermodynamic system, and the liquids of the first and second gas-liquid mixtures are in separate liquid circuits within the thermodynamic system.

3. The thermodynamic system of claim 1, further comprising:

first means for separating the gas and the liquid of the first gas-liquid mixture downstream of the compressing means so that only the liquid of the first gas-liquid mixture passes through the heat sink; and second means for separating the gas and the liquid of the second gas-liquid mixture downstream of the expanding means so that only the liquid of the second gas-liquid mixture passes through the heat source;

wherein the transferring means transfers heat between only the gas of the first gas-liquid mixture after the first fluid stream exits the first separating means and only the gas of the second gas-liquid mixture after the second fluid stream exits the second separating means.

4. The thermodynamic system of claim 3, further comprising means for reducing the pressure of the liquid separated from the first gas-liquid mixture, and means for increasing the pressure of the liquid separated from the second gas-liquid stream.

5. The thermodynamic system of claim 3, further comprising means for equaling the liquid contents of the first and second gas-liquid mixtures.

6. The thermodynamic system of claim 3, wherein the thermodynamic system is a heat pump operating as a reverse Ericsson cycle, the heat source is at a lower temperature than the heat sink, and the transferring means transfers heat from the gas of the first gas-liquid mixture to the gas of the second gas-liquid mixture.

7. The thermodynamic system of claim 6, wherein the heat sink is downstream of the first separating means and the heat source is downstream of the second separating means.

8. The thermodynamic system of claim 6, wherein the heat sink is between the compressing means and the first separating means and the heat source is between the expanding means and the second separating means.

9. The thermodynamic system of claim 3, wherein the thermodynamic system is a heat engine operating as a forward Ericsson cycle, the heat source is at a higher temperature than the heat sink, and the transferring means transfers heat from the gas of the second gas-liquid mixture to the gas of the first gas-liquid mixture.

10. The thermodynamic system of claim 1, wherein the gases of the first and second gas-liquid mixtures are the same and flow in the same gas circuit within the thermodynamic system, and the liquids of the first and second gas-liquid mixtures are the same and flow in the same liquid circuit within the thermodynamic system.

11. The thermodynamic system of claim 10, further comprising:

first means for separating the gas and the liquid of the first gas-liquid mixture downstream of the compressing means so that only the liquid of the first gas-liquid mixture passes through the heat sink; and second means for separating the gas and the liquid of the second gas-liquid mixture downstream of the expanding means so that only the liquid of the second gas-liquid mixture passes through the heat source;

wherein the transferring means transfers heat between only the gas of the first gas-liquid mixture after exiting the first separating means and only the gas of the second gas-liquid mixture after exiting the second separating means.

12. The thermodynamic system of claim 11, wherein the thermodynamic system is a heat pump operating as a reverse Ericsson cycle, the heat source is at a lower temperature than the heat sink, and the transferring means transfers heat from the gas of the first gas-liquid mixture to the gas of the second gas-liquid mixture.

13. The thermodynamic system of claim 11, wherein the heat sink is downstream of the first separating means and the heat source is downstream of the second separating means.

14. The thermodynamic system of claim 11, further comprising means for transferring heat from the liquid of the first gas-liquid mixture after exiting the heat sink to the liquid of the second gas-liquid mixture after exiting the heat source.

15. The thermodynamic system of claim 1, wherein the gases of the first and second gas-liquid mixtures are the same, the liquids of the first and second gas-liquid mixtures are the same, and the first and second fluid streams intermix within the thermodynamic system.

16. The thermodynamic system of claim 15, wherein the thermodynamic system operates as a reverse Brayton cycle, the heat source is at a lower temperature than the heat sink, and the transferring means transfers heat from the gas and the liquid of the first gas-liquid mixture after exiting the compressing means to the gas and the liquid of the second gas-liquid mixture after exiting the expanding means.

17. The thermodynamic system of claim 15, wherein the thermodynamic system operates as a forward Brayton cycle, the heat source is at a higher temperature than the heat sink, and the transferring means transfers heat from the gas and the liquid of the second gas-liquid mixture after exiting the expanding means to the gas and the liquid of the first gas-liquid mixture after exiting the compressing means.

18. The thermodynamic system of claim 15, further comprising means for separating a portion of the liquid of the first gas-liquid mixture downstream of the heat sink, the portion of the liquid flowing through throttling means before being returned to the compressing means.

19. The thermodynamic system of claim 1, wherein the compressing means comprises a scroll compressor.

20. The thermodynamic system of claim 1, wherein the expanding means comprises a scroll expander.

* * * * *